US008501288B2

(12) United States Patent
Katampe

(10) Patent No.: US 8,501,288 B2
(45) Date of Patent: Aug. 6, 2013

(54) IMAGE TRANSFER PAPER

(75) Inventor: Ibrahim Katampe, Kettering, OH (US)

(73) Assignee: Iya Technology Laboratories, LLC, Kettering, OH (US)

( * ) Notice: Subject to any disclaimer, the term of this patent is extended or adjusted under 35 U.S.C. 154(b) by 1581 days.

(21) Appl. No.: 11/950,608

(22) Filed: Dec. 5, 2007

(65) Prior Publication Data

US 2008/0305285 A1 Dec. 11, 2008

Related U.S. Application Data

(60) Provisional application No. 60/873,684, filed on Dec. 8, 2006.

(51) Int. Cl.
*B41M 5/40* (2006.01)

(52) U.S. Cl.
USPC ..... 428/32.72; 428/32.82; 428/32.84

(58) Field of Classification Search
USPC ..... 428/32.72, 32.82, 32.84
See application file for complete search history.

(56) References Cited

U.S. PATENT DOCUMENTS

| | | | | | |
|---|---|---|---|---|---|
| 3,516,842 | A | * | 6/1970 | Klinker, Jr. et al. | 428/40.5 |
| 4,224,358 | A | | 9/1980 | Hare | |
| 4,235,657 | A | | 11/1980 | Greenman et al. | |
| 4,284,456 | A | | 8/1981 | Hare | |
| 4,555,436 | A | * | 11/1985 | Geurtsen et al. | 428/200 |
| 4,737,485 | A | | 4/1988 | Henzel et al. | |
| 4,773,953 | A | | 9/1988 | Hare | |
| 4,863,781 | A | | 9/1989 | Kronzer | |
| 4,966,815 | A | | 10/1990 | Hare | |
| 4,980,224 | A | | 12/1990 | Hare | |
| 5,124,309 | A | * | 6/1992 | Egashira | 503/227 |
| 5,242,739 | A | * | 9/1993 | Kronzer et al. | 428/32.5 |
| 5,271,990 | A | | 12/1993 | Kronzer et al. | |
| 5,294,590 | A | | 3/1994 | Egashira et al. | |
| 5,376,618 | A | | 12/1994 | Uytterhoeven et al. | |
| 5,457,000 | A | | 10/1995 | Defieuw et al. | |
| 5,501,902 | A | | 3/1996 | Kronzer | |
| 5,798,179 | A | | 8/1998 | Kronzer | |
| 5,837,649 | A | | 11/1998 | Nozaki | |
| 5,922,159 | A | | 7/1999 | Cahill | |

(Continued)

FOREIGN PATENT DOCUMENTS

| | | | |
|---|---|---|---|
| EP | 0988991 | | 3/2000 |
| JP | EP 0 988 991 | * | 3/2000 |
| WO | 2004/050262 | | 6/2004 |
| WO | WO 2004/050262 | * | 6/2004 |

OTHER PUBLICATIONS

International Search Report and Written Opinion issued regarding International Application No. PCT/US2007/086466 (May 20, 2008).

(Continued)

*Primary Examiner* — Gerard Higgins
*Assistant Examiner* — Sathavaram I Reddy
(74) *Attorney, Agent, or Firm* — Thompson Hine L.L.P.

(57) ABSTRACT

An image transfer paper including a substrate layer, an image layer positioned relative to the substrate layer, the image layer including at least one of a polyester and a polyurethane and at least one of a micronized polytetrafluoroethylene and a micronized polyethylene, and a release layer positioned between the substrate layer and the image layer, the release layer including a wax component and at least one of a fluoro phosphate ester and a perfluoro phosphate ester.

20 Claims, 2 Drawing Sheets

(56) References Cited

U.S. PATENT DOCUMENTS

| | | | | |
|---|---|---|---|---|
| 5,945,375 | A | 8/1999 | Kroner | |
| 6,113,725 | A | 9/2000 | Kronzer | |
| 6,200,668 | B1 | 3/2001 | Kronzer | |
| 6,224,964 | B1 | 5/2001 | Kawai et al. | |
| 6,265,053 | B1 | 7/2001 | Kronzer et al. | |
| 6,450,633 | B1 | 9/2002 | Kronzer | |
| 6,497,781 | B1 | 12/2002 | Dalvey et al. | |
| 6,551,692 | B1 | 4/2003 | Dalvey et al. | |
| 6,695,446 | B2 | 2/2004 | Sato et al. | |
| 6,758,932 | B2 | 7/2004 | Yamamoto et al. | |
| 6,800,589 | B2 | 10/2004 | Wachi et al. | |
| 6,869,910 | B2 | 3/2005 | Williams et al. | |
| 6,878,227 | B2 | 4/2005 | Xu et al. | |
| 6,878,423 | B2 * | 4/2005 | Nakanishi | 428/32.12 |
| 6,890,623 | B2 | 5/2005 | Onishi et al. | |
| 6,916,751 | B1 | 7/2005 | Kronzer | |
| 6,946,425 | B2 | 9/2005 | Yamamoto et al. | |
| 6,951,671 | B2 | 10/2005 | Mukherjee et al. | |
| 7,026,024 | B2 | 4/2006 | Chang et al. | |
| 2002/0160205 | A1 * | 10/2002 | Garcia et al. | 428/423.1 |
| 2004/0221945 | A1 | 11/2004 | Williams et al. | |

OTHER PUBLICATIONS

International Preliminary Report on Patentability, PCT/US2007/086466 (Jun. 18, 2009).

* cited by examiner

IMAGE TRANSFER PAPER

The present application claims priority from U.S. Ser. No. 60/873,684 filed on Dec. 8, 2006, the entire contents of which are incorporated herein by reference.

BACKGROUND

The present application relates to transfer paper and, more particularly, to non-silicon heat transfer paper.

Transfer papers have been used to transfer images from the transfer paper to a receiving substrate. For example, a user may transfer an image printed on a transfer paper to a garment, such as a t-shirt, by placing the image on the transfer paper into contact with the garment and applying heat to the transfer paper. Once the transfer paper has reached the required temperature, the image on the transfer paper will transfer to the garment.

Prior art transfer papers have presented disadvantages, including cracking of the image after the image has been transferred to the receiving substrate and the inability to directly iron-on the transfer images before or after a wash cycle. Therefore, there is a need for an improved image transfer paper.

SUMMARY

In one aspect, the disclosed image transfer paper may include a substrate layer, an image layer positioned relative to the substrate layer, the image layer including at least one of a polyester and a polyurethane and at least one of a micronized polytetrafluoroethylene and a micronized polyethylene, and a release layer positioned between the substrate layer and the image layer, the release layer including a wax component and at least one of a fluoro phosphate ester and a perfluoro phosphate ester.

In another aspect, the disclosed image transfer paper may include a substrate layer, an image layer positioned relative to the substrate layer, the image layer including at least one of a polyester and a polyurethane and at least one of a polytetrafluoroethylene and a polyethylene dispersed in the polyester and/or polyurethane, and a release layer positioned between the substrate layer and the image layer, the release layer including a wax component and at least one of a fluoro phosphate ester and a perfluoro phosphate ester.

In another aspect, the disclosed image transfer paper may include a substrate layer and an image layer positioned relative to the substrate layer, the image layer including a wax component, at least one of a fluoro phosphate ester and a perfluoro phosphate ester, and a dispersion of at least one of a polytetrafluoroethylene and a polyethylene in at least one of a polyester and a polyurethane.

Other aspects of the disclosed image transfer paper will become apparent from the following description, the accompanying drawings and the appended claims.

DETAILED DESCRIPTION

Figure 1:
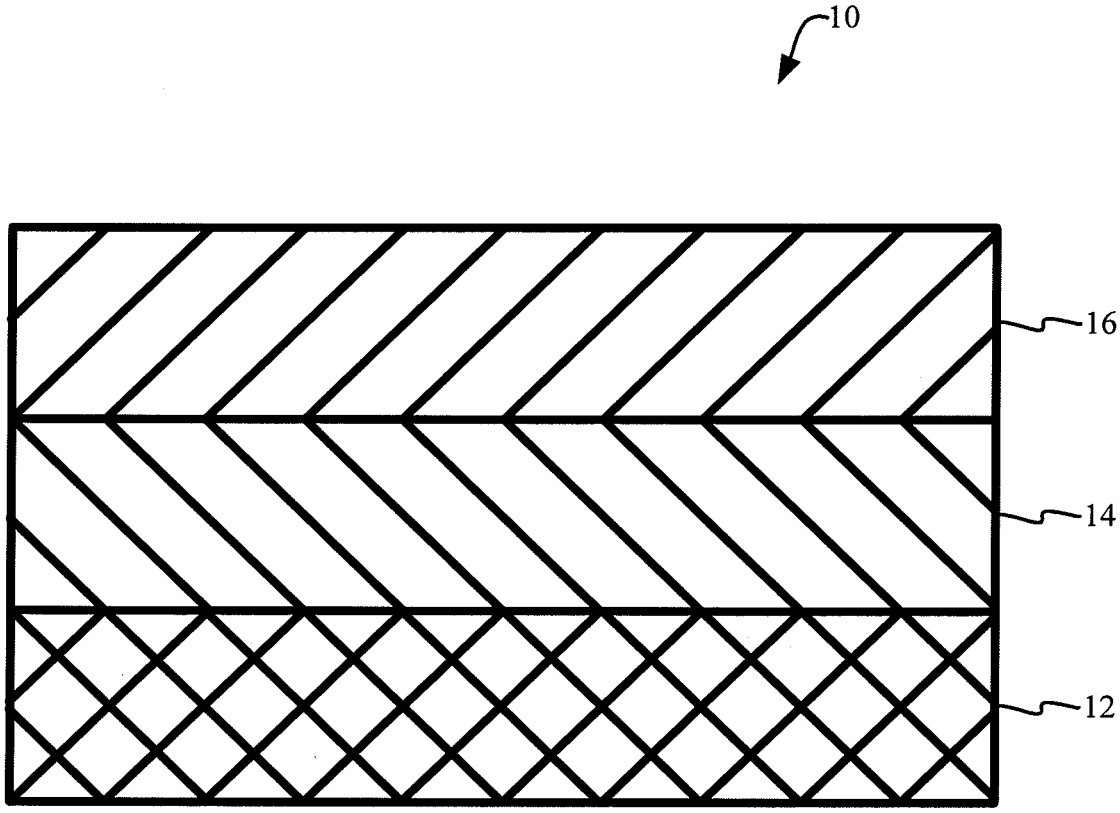
FIG. 1 is a cross-sectional view of a first aspect of the disclosed image transfer paper.

Referring to FIG. 1, a first aspect of the disclosed image transfer paper, generally designated 10, may include a substrate layer 12, a release layer 14 and an image layer 16, wherein the release layer 14 is positioned between the substrate layer 12 and the image layer 16. While the designation "image transfer paper 10" used herein includes the word "paper," the disclosed image transfer paper 10 does not necessarily require or include actual paper as a component thereof.

The image transfer paper 10 may be capable of producing images on both synthetic and non-synthetic receiving substrates (e.g., t-shirts) (not shown) that exhibits similar hot and cold peel characteristics resulting in images that do not crack, are stretchable, and can be ironed-on directly without the coatings sticking to the iron or heat press.

Substrate Layer

The substrate layer 12 may be formed from or may include any suitable material. No limitation is placed on the contents or composition of the substrate layer 12. For example, the substrate layer 12 may be formed from or may include various papers or paperboard materials, such as synthetic paper (e.g., polyolefin or polystyrene-based paper), fine paper, art paper, coated paper, cast coated paper, wall paper, backing paper, synthetic resin or emulsion impregnated paper, synthetic rubber latex impregnated paper, synthetic resin intercalated paper, paperboard and cellulose fiber paper. The substrate layer 12 may also be formed from or may include various plastic materials and films or sheets of such plastic materials, including, for example, polyolefin, polyvinyl chloride, polyethylene terephthalate, polystyrene, polymethacrylate and polycarbonate. Substrate layer 12 may also be formed from or may include white, opaque films or foamed sheets formed from appropriate synthetic resins to which white pigments and fillers may be added.

Those skilled in the art will appreciate that the substrate layer 12 may be formed from multiple sheets or layers that have been laminated together in any desired combination. Examples of appropriate laminates include combined cellulose fiber paper/synthetic paper and combined cellulose fiber paper/plastic films or sheets.

Furthermore, the substrate layer 12 may be coated, uncoated, calendered, C1S, C2S or the like. In one aspect, the substrate layer 12 may be coated with a primer to improve adhesion of the release layer 14 to the substrate layer 12. In another aspect, a surface of the substrate layer 12 may be corona discharge treated to improve adhesion.

Release Layer

The release layer 14 may be a polymer blend including a wax component and a fluoro and/or perfluoro phosphate ester component. The polymer blend may be an aqueous polymer blend and the resulting release layer 14 may be non-film forming. In one aspect, the release layer 14 may be applied to the substrate layer 12 as a water-based emulsion without the need for a barrier layer.

The wax component of the release layer 14 may be a natural wax or a synthetic wax and may be crystalline, non crystalline or semi-crystalline in nature. Examples of appropriate wax components include various thermoplastic resin oligomers such as polyurethane, polystyrene, polyester, polyacrylic, polyethylene, ethylene, polyvinyl chloride, polyvinyl acetate, ethylene/vinyl acetate copolymer, ethylene/acrylic copolymer, polyoxyethylene, polyoxypropylene and polyoxyethylene-propylene oligomers; fatty acids such as myristic, palmitic, margaric, stearic, arachic and montanic acids; fatty acid amides such as caproic, caprylic, lauric, stearic, oleic and eicosanic acid amides; fatty acid esters such as methyl behenate, methyl lignocerate, methyl montanate, pentadecyl palmitate, hexacosyl stearate and carbamic acid [1,4-phenylenebis-(methylene)] bisdimethyl ester; aromatic compounds such as 1,4-dicyclohexylbenzene, benzoic acid, aminobenzophenone, dimethyl terephthalate, fluoranthene, phenols, naphthalenes and phenoxies; and various other waxes.

The fluoro and/or perfluoro phosphate ester component of the release layer 14 may be any fluoro or perfluoro phosphate ester or combinations of fluoro and/or perfluoro phosphate esters.

In one aspect, the release layer 14 may be substantially free of silicone and silicone-based components.

Image Layer

The image layer 16 may be coated or otherwise applied to the release layer 14 and may include a synergistic blend of polymers, copolymers and/or resins and may provide a non-film forming, non-continuous layer.

In one aspect, the image layer 16 may include (1) polyester and/or polyurethane and (2) micronized polytetrafluoroethylene and/or polyethylene. The polyester and/or polyurethane may be applied to the image layer 16 as a dispersions, an emulsions or as a resin.

Additionally, various other resin systems may be included in the image layer 16, including polypropylene; halogenated polymers, e.g., polyvinyl chloride and polyvinylidene chloride; vinylic polymers, e.g., polyvinyl acetate, vinyl chloride/vinyl acetate copolymers, ethylene/vinyl acetate copolymers and polyacrylates; polyester type resins, e.g., polyethylene terephthalate and polybutylene terephthalate; acetal resins, e.g., polyvinyl acetacetal and polyvinyl butyral; polystyrene type resins; polyamide type resins; polyurethane resins; copolymeric resins, e.g., copolymers of olefins such as ethylene and propylene with other vinyl monomers; ionomers; cellulosic resins, e.g., cellulose diacetate and cellulose triacetate; and polycarbonates. Those skilled in the art will appreciate that the resins listed above may be used alone or in combinations of two or more.

The disclosed (co)polyester of the image layer 16 may be obtained by condensing one or more dicarboxylic acids with one or more diols including aromatic and aliphatic dicarboxylic acids and diols and including one or more of the present hydroxy-carboxylic acids containing a long chain alkyl or alkylene group. The condensation may also be carried out by using derivatives of the dicarboxylic acids in the form of their corresponding esters and/or derivatives of the diols in the form of their corresponding epoxides or in the form of their corresponding acetates.

Furthermore, the following resins may be used in addition to, or as a blend with, the (co)polyester:

1. resins having ester bonds, such as polyester resins, polyacrylic ester resins, polycarbonate resins, polyvinyl acetate resins, styrene-acrylate resins, vinyl toluene-acrylate resins and the like;
2. resins having urethane bonds, such as polyurethane resins and the like;
3. resins having amide bonds, such as polyamide resins;
4. resins having urea bonds, such as urea resins and the like; and
5. other resins having highly polar bonds, such as polycaprolactone resins, polystyrene resins, polyvinyl chloride resins, polyacrylonitrile resins and cellulose derivatives.

The resins listed above as items 1-5 may be used individually or as a mixture of two or more in combination with the (co)polyester resin.

The image layer may additionally include the following polymers, which are available as powders and/or dispersions: polyolefins, such as low density polyethylene (LDPE), high density polyethylene (HDPE), low density polypropylene (LDPP) and high density polypropylene (HDPP), ethylene acrylic acid (EAA), ethylene vinyl acetate (EVA), methane acrylic ethylene acrylic (MAEA), polyamide and mixtures or copolymers thereof.

Figure 2:
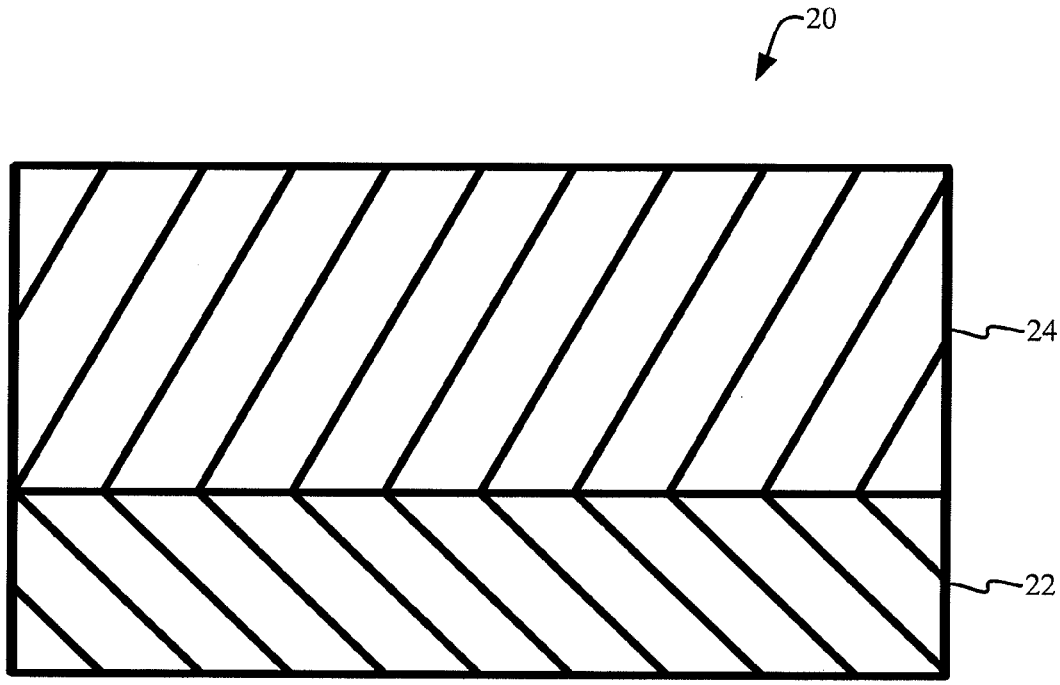
FIG. 2 is a cross-sectional view of a second aspect of the disclosed image transfer paper.

Referring to FIG. 2, a second aspect of the disclosed image transfer paper, generally designated 20, may include a substrate layer 22 and an image layer 24. The substrate layer 22 may be formed from or may include any suitable material, such as the materials and components discussed above with respect to substrate layer 12 of FIG. 1. The image layer 24 may be a combination of the components of the release layer 14 and image layer 16 of FIG. 1. In particular, in one aspect, image layer 24 may include a wax component, a fluoro and/or perfluoro phosphate ester component, polyester and/or polyurethane blend component and a micronized polytetrafluoroethylene and/or polyethylene component.

At this point, those skilled in the art will appreciate that the image layer 24 of transfer paper 20 may be a combination of the components forming the image layer 16 and release layer 14 of transfer paper 10.

Accordingly, images deposited onto the disclosed image transfer paper 10 may be transferred onto various receiving substrates, while retaining a generally soft feel and remaining generally flexible and stretchable. The receiving substrates may be flexible, non flexible, synthetic, non-synthetic, and blends of synthetic and non-synthetic material. For example, the receiving substrate may be a garment formed from cotton, LYCRA® (Invista North America S.A.R.L. of Wilmington, Del.), spandex or a cotton/poly blend.

EXAMPLES

Example 1

A layered transfer paper was prepared having a substrate layer, a release layer and an image layer. The substrate layer was a C1S clay coated paper having a basis weight of 50-60 pounds per ream available from MeadWestvaco Corporation.

A release composition was prepared as combination of ethylene vinyl acetate copolymer and NOVEC FC4200, a fluoro aliphatic polymeric ester. The release composition was applied to the uncoated side of the substrate layer.

An image layer composition was prepared as a low density polyethylene and polytetrafluoroethylene dispersion in polyurethane. The image layer composition was applied over the release layer to form an image layer. The resulting three layer structure was allowed to dry at room temperature.

Example 2

A layered transfer paper was prepared having a substrate layer, a release layer and an image layer. The substrate layer was an uncoated paper having a basis weight of 50-60 pounds per ream available from MeadWestvaco Corporation.

A release composition was prepared as a combination of ethylene vinyl acetate copolymer and NOVEC FC4200, a fluoro aliphatic polymeric ester. The release composition was applied to the uncoated side of the substrate layer.

An image layer composition was prepared as a low density polyethylene and polytetrafluoroethylene dispersion in ViTEL® 2700 Polyester resin. The image layer composition was applied over the release layer to form an image layer. The resulting three layer structure was allowed to dry at room temperature Accordingly, the disclosed transfer papers 10, 20 incorporate new technology that may be used on both synthetic and natural fibers. The disclosed transfer papers 10, 20 may be made as either 2 or 3 layer structures, wherein the two-layer structure includes a blend of the release layer and image layer prior to coating. However, those skilled in the art will appreciate that additional layers may be used without departing from the scope of the present disclosure. Furthermore, the disclosed transfer papers 10, 20 may be non-silicone.

Although various aspects of the disclosed image transfer paper have been shown and described, modifications may occur to those skilled in the art upon reading the specification. The present application includes such modifications and is limited only by the scope of the claims.

What is claimed is:

1. An image transfer paper comprising:

a substrate layer;

an image layer positioned relative to said substrate layer, said image layer including a polyester or a polyurethane, and at least one of a micronized polytetrafluoroethylene or a micronized polyethylene; and a release layer positioned between said substrate layer and said image layer, said release layer including a wax component and at least one of a fluoro phosphate ester or a perfluoro phosphate ester.

2. The image transfer paper of claim 1 wherein said substrate layer includes a paper-based material.

3. The image transfer paper of claim 1 wherein said substrate layer is formed as a film.

4. The image transfer paper of claim 1 wherein said substrate layer is a laminate.

5. The image transfer paper of claim 1 wherein said substrate layer is coated.

6. The image transfer paper of claim 1 wherein said at least one of said micronized polytetrafluoroethylene and or said micronized polyethylene is dispersed in said at least one of said polyester or said polyurethane.

7. The image transfer paper of claim 6 wherein said image layer further includes at least one of a polypropylene, a halogenated polymer, a vinylic polymer, an acetal resin, a polystyrene resin, a polyamide resin, an ionomer, a cellulosic resin or a polycarbonate.

8. The image transfer paper of claim 1 wherein said at least one of said polyester or said polyurethane is applied as a dispersion or emulsion.

9. The image transfer paper of claim 7 wherein said wax component includes at least one of a thermoplastic resin oligomer, a fatty acid, a fatty acid amide, a fatty acid ester or an aromatic compound.

10. The image transfer paper of claim 9 wherein said wax component includes ethylene vinyl acetate.

11. The image transfer paper of claim 10 wherein said release layer is discontinuous.

12. The image transfer paper of claim 10 wherein said image layer is discontinuous.

13. The image transfer paper of claim 1 wherein said image layer and said release layer are free of silicone.

14. An image transfer paper comprising:

a substrate layer;

an image layer positioned relative to said substrate layer, said image layer including at least one of a polyester or a polyurethane and at least one of a polytetrafluoroethylene or a polyethylene dispersed in said at least one of said polyester or said polyurethane; and a release layer positioned between said substrate layer and said image layer, said release layer including a wax component and at least one of a fluoro phosphate ester or a perfluoro phosphate ester.

15. The image transfer paper of claim 14 wherein said wax component includes ethylene vinyl acetate.

16. An image transfer paper comprising:

a substrate layer; and an image layer carried on said substrate layer, said image layer including:

(a) a wax component, (b) at least one of a fluoro phosphate ester or a perfluoro phosphate ester, and (c) a dispersion of at least one of a polytetrafluoroethylene or a polyethylene in at least one of a polyester or a polyurethane.

17. The image transfer paper of claim 16 wherein said polytetrafluoroethylene and said polyethylene are micronized.

18. The image transfer paper of claim 17 wherein said wax component includes ethylene vinyl acetate.

19. The image transfer paper of claim 18 wherein said image layer is discontinuous.

20. The image transfer paper of claim 19 wherein said image layer is free of silicone.

* * * * *